United States Patent [19]

Nelson et al.

[11] 4,147,393

[45] Apr. 3, 1979

[54] DRAWER SLIDE MOUNT EMPLOYING A SLIDE ELEMENT AND COOPERATIVE CLIP

[75] Inventors: Larry J. Nelson, Belmont; John E. Fortuna, II, Cedar Springs, both of Mich.

[73] Assignee: Knape & Vogt Manufacturing Co., Grand Rapids, Mich.

[21] Appl. No.: 861,104

[22] Filed: Dec. 16, 1977

[51] Int. Cl.[2] ..... F16C 21/00

[52] U.S. Cl. ..... 308/3.6; 312/350

[58] Field of Search ..... 312/345, 350; 308/3.6, 308/3.8

[56] References Cited

U.S. PATENT DOCUMENTS

| | | | |
|---|---|---|---|
| 3,712,698 | 1/1973 | Propst et al. | 312/350 |
| 3,716,284 | 2/1973 | Vogt | 308/3.6 |

*Primary Examiner*—Galen L. Barefoot
*Assistant Examiner*—Douglas C. Butler
*Attorney, Agent, or Firm*—Price, Heneveld, Huizenga & Cooper

[57] ABSTRACT

Drawer rail assemblies are attached to slotted vertical standards with special supports, each support having a clip and a slide element. The clip has projecting tabs to fit within the slots of the vertical standards at the selected height, and has ear portions forming a slide channel for retaining the slide element. The slide element has orifices to receive fasteners which attach the drawer rail thereto and also secure the slide element against further sliding motion in the clip.

7 Claims, 7 Drawing Figures

DRAWER SLIDE MOUNT EMPLOYING A SLIDE ELEMENT AND COOPERATIVE CLIP

BACKGROUND OF THE INVENTION

This invention relates to drawer rail supports.

Drawer rail assemblies made up of a plurality of telescoping rails are typically mounted in a cabinet by affixing the support rail thereof to the cabinet interior with fasteners such as screws. Often it is desirable to be able to vertically adjust the rail assemblies in the cabinet. A way has been devised to achieve vertical adjustability by the use of slotted standards or pilaster strips to support the rail assemblies. Specifically, this involves special rails with a pair of brackets having tabs welded to the support rail of each drawer rail assembly, to allow such to be selectively inserted into engagement with slots in the vertical standards. But, not only do the welded attachments add to production cost and complexities, this type of construction also requires the standards to be mounted in the cabinet spaced exactly from each other to match the spacing of the welded clips on the support rail. This is often difficult. And, the standards have to be carefully spaced from the cabinet front to allow the drawer to fully close. Because draw fronts and cabinet fronts vary in style and thickness, this exact spacing can also be difficult. Moreover, the drawer rails so modified have only this one specific use, requiring separate inventory thereof by each party along the distribution chain of drawer rail products.

A need has existed for a structure which would supply vertical adjustability without specially made drawer rails being required, and would also enable vertical standards to be attached in the cabinet without such exacting spacing requirements relative to each other and relative to the front of the cabinet, thereby accommodating different style fronts of the cabinet and drawers.

SUMMARY OF THE INVENTION

The present invention uniquely enables a conventional drawer rail assembly to be installed into a cabinet in a fashion to be selectively positioned at a chosen elevation, and to be later quickly and easily changed to other elevations if desired. Slotted vertical standards or pilaster strips support the drawer rail assemblies and the drawer supported thereon at the chosen elevation. Special mounts interconnect the drawer rail assemblies with the vertical standards. These special mounts allow vertical adjustment of the rail assemblies, and accommodate drawer rails with a variety of screw hole locations. The mounts further accommodate variations in the spacing between front and rear vertical standards, so that the standards need not be exactly positioned in the cabinet during assembly. And, when the drawer rail assemblies are mounted, the special mounts enable easy adjustment of the support rail relative to the front of the cabinet, to accommodate various styles and dimensions of drawer front and cabinet front for complete drawer closing.

These and other features and objects of the invention will be readily apparent to those in the art upon studying the following specification in conjunction with the drawings.

DESCRIPTION OF THE PREFERRED EMBODIMENT

Figure 2:
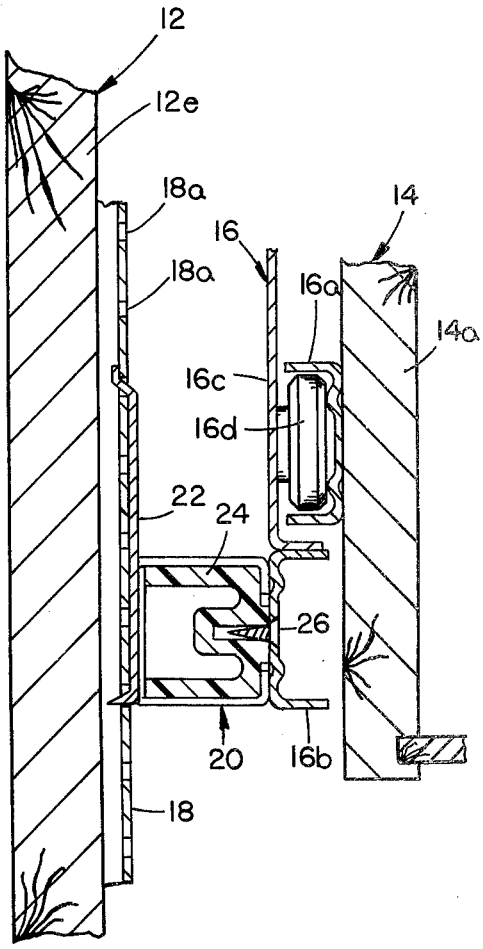
FIG. 2 is an enlarged, sectional, end elevational view of a portion of the apparatus in FIG. 1, taken on plane II—II.
Figure 6:
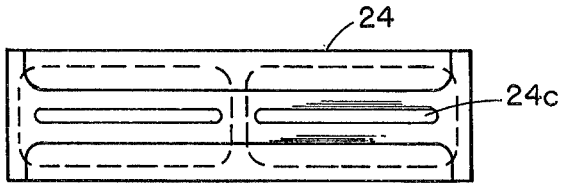
FIG. 6 is a front elevational view of the slide element component of the mount in FIG. 5.
Figure 7:
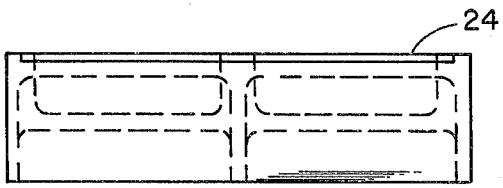
FIG. 7 is a plan view of the component in FIG. 6.

Referring now specifically to the drawings, the assembly 10 is shown to include a cabinet 12 within which one or more drawers 14 (FIG. 2) are to be mounted by a pair of drawer rail assemblies 16 of conventional type, e.g. those shown in U.S. Pat. No. 3,243,247. The cabinet defines an inner recessed area encompassed by a bottom **12*a*, a top 12*b*, a pair of sides 12*e*, a rear 12*f*** and a front having one or more openings to receive one or more drawers.

Figure 1:
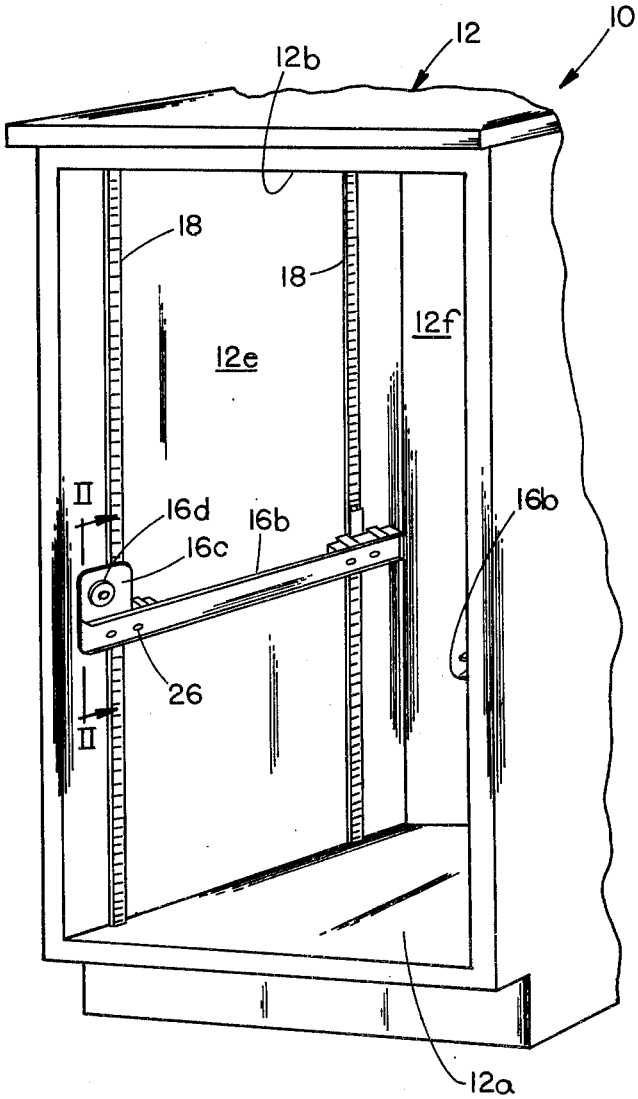
FIG. 1 is a fragmentary perspective view of a cabinet and the support rail of a drawer rail assembly mounted to vertical standards in the cabinet, in accordance with the present invention.

Each drawer rail assembly 16 typically includes a drawer rail **16*a* mounted to the outside face of vertical panel 14*a* of the drawer 14, and a case rail, i.e. support rail 16*b* having integrally secured thereto an upstanding frontal bracket 16*c* with a roller member 16*d* thereon to allow the drawer and drawer rail to be shifted into and out of the cabinet enclosure. The assembly may include an intermediate rail in some instances, as in the drawer rail assemblies of U.S. Pat. No. 3,278,250 or 3,298,768. Mounted to the inside walls 12*e* of both sides of the cabinet are two pairs of slotted vertical standards or pilaster strips, one pair of which is shown at 18 in FIG. 1. These each include vertically spaced slots 18*a***. The standards are spaced horizontally from each other and spaced horizontally inwardly from the cabinet front, being mounted to the cabinet walls by screws or other suitable fastening means.

The pair of drawer rail assemblies are mounted to the two pairs of slotted vertical standards by special mounts 20, there being a pair of mounts for each drawer rail assembly, i.e. one mount per vertical standard for each drawer, such that a typical drawer would have four mounts for its two pairs of drawer rail assemblies and four vertical standards. Each mount includes a metallic clip element 22 and a slide block element 24 interfitted with the clip element.

Figure 4:
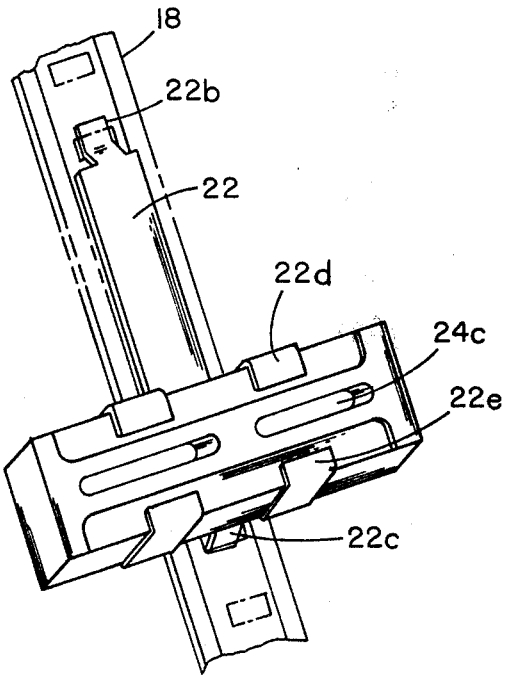
FIG. 4 is a fragmentary perspective view of the two components in FIG. 3, taken from a lower elevation, showing them interfitted and with the standard in phantom lines.

Each clip 22, preferably of metal, has a main body **22*a* with an upstanding portion having an upper rearwardly protruding offset tab projection 22*b* thereon for interfitting with one slot 18*a* of standard 18, the lower end of the clip body having a second rearwardly protruding tab projection 22*c* for interfitting with lower slot of vertical standard 18. The lower slot and tab interfit provide vertical and lateral compressive support while the upper tab and slot interfit restrain the assembly in tension against rotational movement, the upper tab engaging against the inner surface of the standard immediately above the slot into which it interfits (see FIG. 4**).

This clip also defines a special slide channel on the front thereof.

Figure 3:
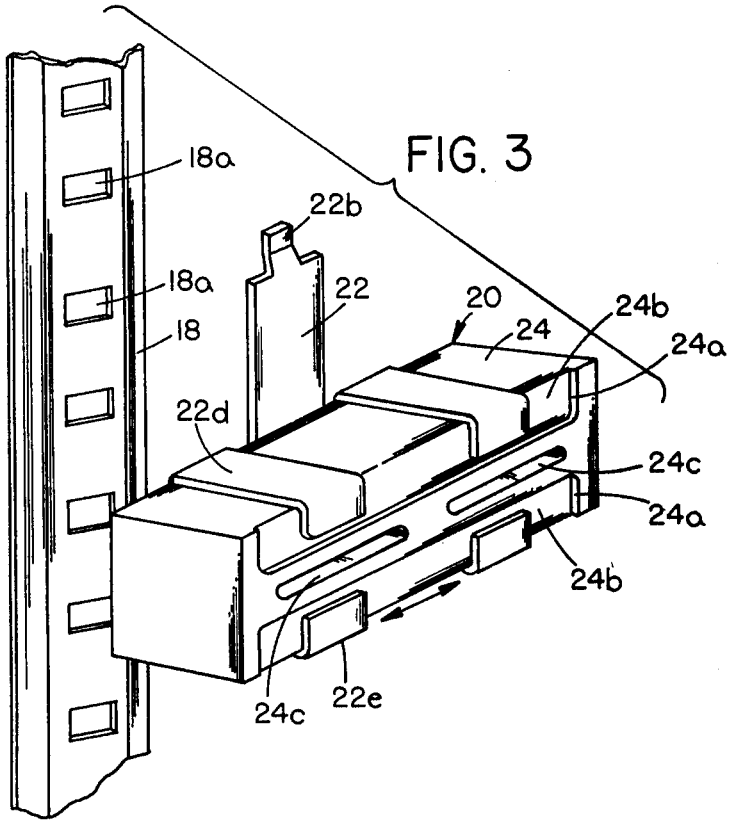
FIG. 3 is a fragmentary enlarged perspective view of one of the vertical standards in FIG. 1 plus its cooperating special mount of this invention.
Figure 5:
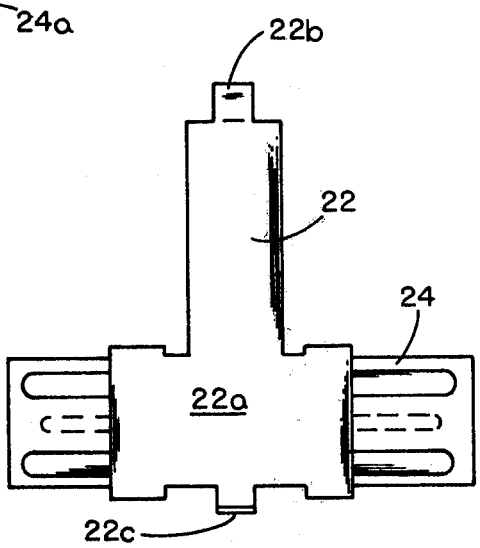
FIG. 5 is a rear elevational view of the mount in FIG. 3.

More specifically, a plurality of integral ears, i.e. upper ears 22d of inverted L-shaped configuration, and lower ears 22e of L-shaped configuration, cooperatively define a slide channel of configuration like the periphery of slide block element 24. In the embodiment depicted, element 24 is basically rectangular or square in cross section such that slide element 24 can, prior to final assembly, move forward and rearwardly as depicted by the double arrow in FIG. 3, i.e. in the same direction as the main dimension of the drawer rail assembly and the normal drawer movement.

Slide block element 24 is formed of a material which will readily slide within the slide channel, being dimensioned to have sufficient clearance for this purpose, preferably being of a lubricious material such as a polymer, e.g. nylon, but also being potentially formable of wood or other suitable substitute. It basically has a cross-sectional configuration matching that of the slide channel, but including stop means on each end to limit the sliding movement thereof relative to the clip. In the specific embodiment depicted, stop shoulder surfaces 24a are formed on opposite ends of elongated recesses 24b on the outer face of the slide block, for cooperative abutment with the terminal portions of ears 22d and 22e. Each of these slide blocks also includes fastener receiving orifices, in the face of the block toward the drawer rail. The slots 24c are elongated in the main dimension of the slide block, i.e. in the direction of the main dimension of the drawer rail assemblies and drawer movement, to receive fasteners 26 (FIG. 2) projecting through openings in the drawer rail 16b. These fasteners are preferably self-tapping screws which, when installed, secure rail 16b to the mount, and when doing so, press the terminal portions of ears 22d and 22e into abutment with slide block 24 by being squeezed between rail 16b and slide block 24 (FIG. 2) to thereby lock the slide element into position and against further sliding on clip 22.

The slidability of element 24 relative to the clip and thus relative to the vertical standards, prior to this tightening down step with fasteners 26, as well as the slotted shape of openings 24c in the slide block to allow variation in the position of the screws therein, offer distinct advantages for assembly. More specifically, these advantages include the use of a possible variety of screw hole locations on the drawer slide without limiting the position of the vertical standards, accommodation of variations in the spacing between the front and rear standards, and adjustability of the drawer slide cabinet member relative to the front of the cabinet to enable proper opening and closing of the drawer with various styles and dimensions of drawer fronts and cabinet fronts. The novel mounts provide tremendous flexibility in assembly, rendering the use of a conventional drawer rail assembly in a fashion to allow vertical adjustability of the drawer as desired or necessary, yet without exacting requirements for positions of the vertical standards in the cabinet relative to each other and to the cabinet front.

Mounting of the drawer and drawer rail assemblies is relatively simple. Specifically, four standards 18 are secured to the cabinet side walls, four of the novel mounts 20 are interfitted with the four vertical standards 18 by simply sliding the upper tab 22b into an appropriate slot, and projecting the lower tab 22c into the corresponding downwardly spaced slot while placing all four of the mounts at the same elevation within the cabinet. Then the case rail 16b of the drawer rail assembly is attached by inserting screws 26 through the openings provided in the case rail and into the slots 24c of each mount, and specifically the slide block thereof, but not tightening such securely. Next the drawer 14 to which a pair of drawer rails 16a have been attached on opposite sides thereof is slidably inserted with the case rail and moved to the desired open and closed positions of the drawer. The self-tapping screws within the slots 24c, and the movement of the slide block within its slide channel of the clip enables this to be easily achieved. Then the drawer and drawer rails are removed momentarily from the case rails and fasteners 26 are tightened securely, causing each case rail 16b to lock the vertical terminal portions of the ears 22d and 22e against its respective pair of slide blocks to secure the slide block against further sliding motion in the clip and to anchor the screw fasteners 26 in a particular location in slots 24c. Finally the drawer and drawer rails are slidably replaced and the unit is ready for operation.

If at any time it is desired to vertically move the drawer rail assemblies and drawer, the operation is simply reversed, the new location is selected, and the assembly is resecured in the fashion described above.

Certain additional advantages and minor changes in construction will be apparent to those in the art upon studying this disclosure. Thus, the invention is intended to be limited by the claims attached rather than to the specific preferred embodiment set forth herein.

The embodiments of the invention in which an exclusive property or privilege is claimed are defined as follows.

1. A drawer rail support assembly comprising:
- slotted vertical standards having a plurality of vertically spaced slots therein;
- a drawer rail support for each vertical standard, including a clip and a slide element;
- said clip having projections for interfitting with said slots at a selected elevation and having portions defining a slide channel for said slide element;
- said slide element having fastener receiving orifices for attachment of a drawer rail thereto;
- said clip portions and slide element being arranged for securement of said slide element against sliding in said slide channel when the drawer rail is attached to said slide element.

2. A mount for attaching a drawer rail assembly to slotted vertical standards comprising:
- a clip and a slide element interfitting therewith;
- said clip having projections for interfitting with a slotted standard, and having portions defining a slide channel for said slide element;
- said slide element being slidably interfitted in said slide channel for sliding movement, and having means for cooperation with drawer rail attaching fasteners to attach a drawer rail to said mount.

3. A mount for attaching a drawer rail assembly to slotted vertical standards comprising:
- a clip and a slide element interfitting therewith;
- said clip having vertically spaced uppere and lower projections for interfitting with a slotted standard, and having portions defining a laterally oriented slide channel for said slide element;
- said slide element being slidably retained in said slide channel for limited sliding movement, and having orifice means for receiving drawer rail attaching fasteners.

4. The mount in claim 3 wherein said clip has a body from which said projections and said portions extend, said portions extending adjacent said orifice means to be between the drawer rail assembly and said slide element to cause the fasteners to retain said slide element against sliding when secured.

5. The mount in claim 3 wherein said orifice means comprise slots elongated in the direction of said slide element sliding movement.

6. The mount in claim 3 including stops to limit the sliding movement of said sliding element in said slide channel.

7. A drawer rail and support assembly comprising:

a plurality of slotted vertical standards each having a plurality of vertically spaced slots therein;

a drawer rail mount for each vertical standard, including a clip and a slide element;

said clip having projections for interfitting with said slots at a selected elevation and portions defining a slide channel for said slide element;

each said slide element having fastener receiving orifices for attachment of a drawer rail thereto;

drawer rails attached to said mounts by fasteners received in said orifice, said fasteners causing said clip and said slide element to bind together to restrain sliding of said slide element in said slide channel when the drawer rail is attached to said slide element.

* * * * *